US007237814B2

(12) United States Patent
Handzlik

(10) Patent No.: US 7,237,814 B2
(45) Date of Patent: Jul. 3, 2007

(54) CONVERTIBLE SNOW SHOVELING DEVICE

(76) Inventor: Walter A. Handzlik, 4808 Mayfield Rd., West Bend, WI (US) 53095

( * ) Notice: Subject to any disclaimer, the term of this patent is extended or adjusted under 35 U.S.C. 154(b) by 0 days.

(21) Appl. No.: 10/808,994

(22) Filed: Mar. 25, 2004

(65) Prior Publication Data

US 2005/0012348 A1 Jan. 20, 2005

Related U.S. Application Data

(60) Provisional application No. 60/487,742, filed on Jul. 16, 2003.

(51) Int. Cl.
*A01B 1/20* (2006.01)

(52) U.S. Cl. ..... 294/54.5; 294/51

(58) Field of Classification Search ..... 294/51, 294/54.5; 403/381; 37/281
See application file for complete search history.

(56) References Cited

U.S. PATENT DOCUMENTS 281,158 A 7/1883 Stegner
2,538,654 A * 1/1951 Petersen ..... 403/381
4,073,077 A * 2/1978 Essel et al. ..... 37/281
4,878,704 A * 11/1989 Jacanin et al. ..... 294/54.5
4,910,893 A * 3/1990 Asay ..... 37/281
4,991,324 A 2/1991 Fine et al. ..... 37/284
5,228,734 A 7/1993 Pollastro ..... 294/54.5

* cited by examiner

*Primary Examiner*—Gene O. Crawford
*Assistant Examiner*—Esther O. Okezie
(74) *Attorney, Agent, or Firm*—Andrus, Sceales, Starke & Sawall, LLP

(57) ABSTRACT

A convertible snow shoveling device includes first and second shovels, each having a substantially planar blade, an elongated handle and a hand grip. At least one male connection part extends from an edge portion of the first shovel blade and at least one female connection part is disposed along an edge portion of the second shovel blade. The at least one female connection part of the second shovel blade is sized and shaped to receive the at least one male connection part of the first shovel blade to releasably couple the first and second shovel blades together and form the convertible shoveling device. A handlebar is provided for releasably coupling the hand grips on the first and second shovels together. The male and female connections together with the handlebar permit the pair of individual snow shovels to be easily converted from a pair of individual snow shovels into a wide blade double handle snow shoveling device.

4 Claims, 7 Drawing Sheets

CONVERTIBLE SNOW SHOVELING DEVICE

CROSS-REFERENCE TO RELATED APPLICATION

This application claims priority to Provisional Patent Application No. 60/487,742 filed Jul. 16, 2003.

FIELD OF THE INVENTION

The present invention relates generally to a device for shoveling snow. More particularly, the present invention is directed to a wide blade double handle device for shoveling snow that has at least a pair of substantially planar shovel blades with edge portions that are releasably coupled together which enables the shoveling device to be converted into individual snow shovels.

BACKGROUND OF THE INVENTION

Typical snow shovels include an elongated handle member attached to a substantially planar shovel blade. Shovel blades vary in shape and size depending upon their intended application. For example, larger generally rectangular shovel blades are typically used to remove light snow cover from larger areas, such as driveways, streets, parking lots, and the like. The larger-sized shovel blades cover more area in fewer passes, minimizing effort required to clear snow. Smaller generally square-shaped shovel blades are typically used to remove heavy snow from smaller areas, such as sidewalks, decks, porches, other walkways, and the like. The smaller-sized shovel blades are easily maneuvered and afford the ability to efficiently remove heavy snow and snow from hard-to-reach areas with minimal effort.

The prior art teaches several convertible and/or expandable snow clearing devices that are adaptable to selectively increase or decrease the overall blade area. For example, Jacanin, Jr. et al U.S. Pat. No. 4,878,704 disclose a wide blade, double handle snow pusher which may be used as a plow for pushing snow. The snow pusher is constructed of two standard snow shovels having blades aligned side-by-side and interconnected by an intermediate blade member having a resilient clamp or spring member. A cross bracing member is connected to the handles of the individual snow shovels to provide additional stability.

Fine et al U.S. Pat. No. 4,991,324 teaches a manual snow removal device that includes of a pair of snow shovels interconnected by rigidly affixed parallel plates. A locking mechanism, such as a bolt, passes through the parallel plates and the blades of the snow shovels to disengagably lock the blades together.

Pollastro U.S. Pat. No. 5,228,734 teaches an expandable snow shovel device. A series of side blade elements are releasably fixed to the opposing sides of a central blade. The side and central blade elements have upwardly extending flanges adjacent to their lateral edges through which connecting members, such as lock pins, adjoin the respective blade elements.

All known convertible snow shovels, such as those described above, require separate locking means, such as bolts, pins, screws or brackets to attach smaller shovel blades together to form a larger sized shovel blade. Snow shovels are typically employed in cold weather environments and therefore encounter large amounts of ice, snow, dirt and/or other debris, which can often interfere with the workings of the connecting means. Build-up of ice, snow, dirt and/or rust on the connection means of the known convertible snow shovels often makes it difficult to attach and detach the shovel blades.

It is therefore desirable to provide a snow shovel device having means for selectively changing the width of the shovel blade that are simple and require minimal parts, thus increasing the ease of use and minimizing the chance for mechanical breakdown. It is desirable to provide a single snow shovel device that is easily and efficiently adaptable to perform as a small shovel blade for smaller areas and alternately as a large shovel blade for larger areas. More specifically, it is desirable to provide a single snow shovel device that has means for selectively increasing or decreasing the size of the shovel blade, such that the shovel device is useful for a wide range of snow conditions and snow covered areas.

SUMMARY OF THE INVENTION

The present invention relates to a convertible snow shoveling device for clearing snow from a snow covered surface. The convertible snow shoveling device comprises a plurality of substantially planar shovel blades and means for releasably coupling the shovel blades together to form a single larger blade. Preferably, at least one handle element is coupled to and projects from at least one of the plurality of shovel blades. In addition, there is optionally provided means for releasably coupling the handles together to provide added rigidity to the assembled blades as well as convenience of use thereof.

In a preferred embodiment, the convertible snow shoveling device includes first and second shovels each having substantially planar shovel blades. Each of the first and second shovels function individually as smaller sized snow shovels. At least one male connection part extends from an edge portion of the shovel blade of the first shovel and at least one female connection part is disposed along an edge portion of the shovel blade of the second shovel. The at least one female connection part is sized and shaped to receive the at least one male connection part to releasably couple the blades of the first and second shovels together to form the convertible snow shoveling device.

The at least one male connection part may include a post disposed along and extending parallel to the edge portion of the first shovel blade and the at least one female connection part may include a slotted tube disposed along the edge portion of the second shovel blade which is sized to receive the post. In such an arrangement, the post is slidably inserted into the slotted tube to easily engage and disengage the first and second shovel blades. Alternately, the female connection part may be disposed along the back of the edge portion of the second shovel blade. In this embodiment the shovel blades, when coupled together, slightly overlap.

In one embodiment, the at least one male connection part may include a plurality of tabs disposed along and extending outwardly from the edge portion of the first shovel blade and the at least one female connection part may comprise a plurality of slots disposed along the edge portion of the second shovel blade and sized to receive the plurality of tabs. In such an arrangement, the plurality of tabs are slidably inserted into the plurality of slots to easily engage and disengage the first and second shovel blades.

In another embodiment, the at least one male connection part may include a plurality of L-shaped tabs disposed along and extending outwardly and downwardly from the edge portion of the first shovel blade and the at least one female connection part may comprise a plurality of loops disposed along the edge portion of the second shovel blade and sized to receive the plurality of L-shaped tabs. In such an arrangement, the L-shaped tabs are inserted into the corresponding loops to releasably couple the blades of the first and second shovels together.

In yet another embodiment the at least one male connection part may include a plurality of mushroom-shaped pegs and the at least one female connection part may comprise a plurality of notched keyholes or a combination of slotted and notched keyholes. In such an arrangement, the mushroom-shaped pegs are inserted into the corresponding keyholes to releasably couple the blades of the first and second shovels together.

In general, the male and female connection parts afford releasable coupling of the shovel blades of the first and second shovels to create a single larger convertible snow shoveling device. Disengaging the male and female connection easily converts the device back to individual snow shovels.

An elongated handlebar is provided which is releasably coupled to the hand grips of the convertible snow shoveling device to allow a single user to easily maneuver the convertible snow shoveling device while shoveling snow. This embodiment affords the use of each of the first and second shovels separately or together, depending upon the task at hand. The handlebar may also be adapted to be releasably coupled to the elongated handle for easy storage.

BRIEF DESCRIPTION OF THE DRAWINGS

The invention will be understood by reference to the following drawings.

DETAILED DESCRIPTION OF THE PREFERRED EMBODIMENTS

In the preferred embodiment of the present invention described in detail below, a convertible snow shoveling device is provided. It should be understood that the drawings and specification are to be considered an exemplification of the principles of the invention, which is more particularly defined in the appended claims.

Figure 1:
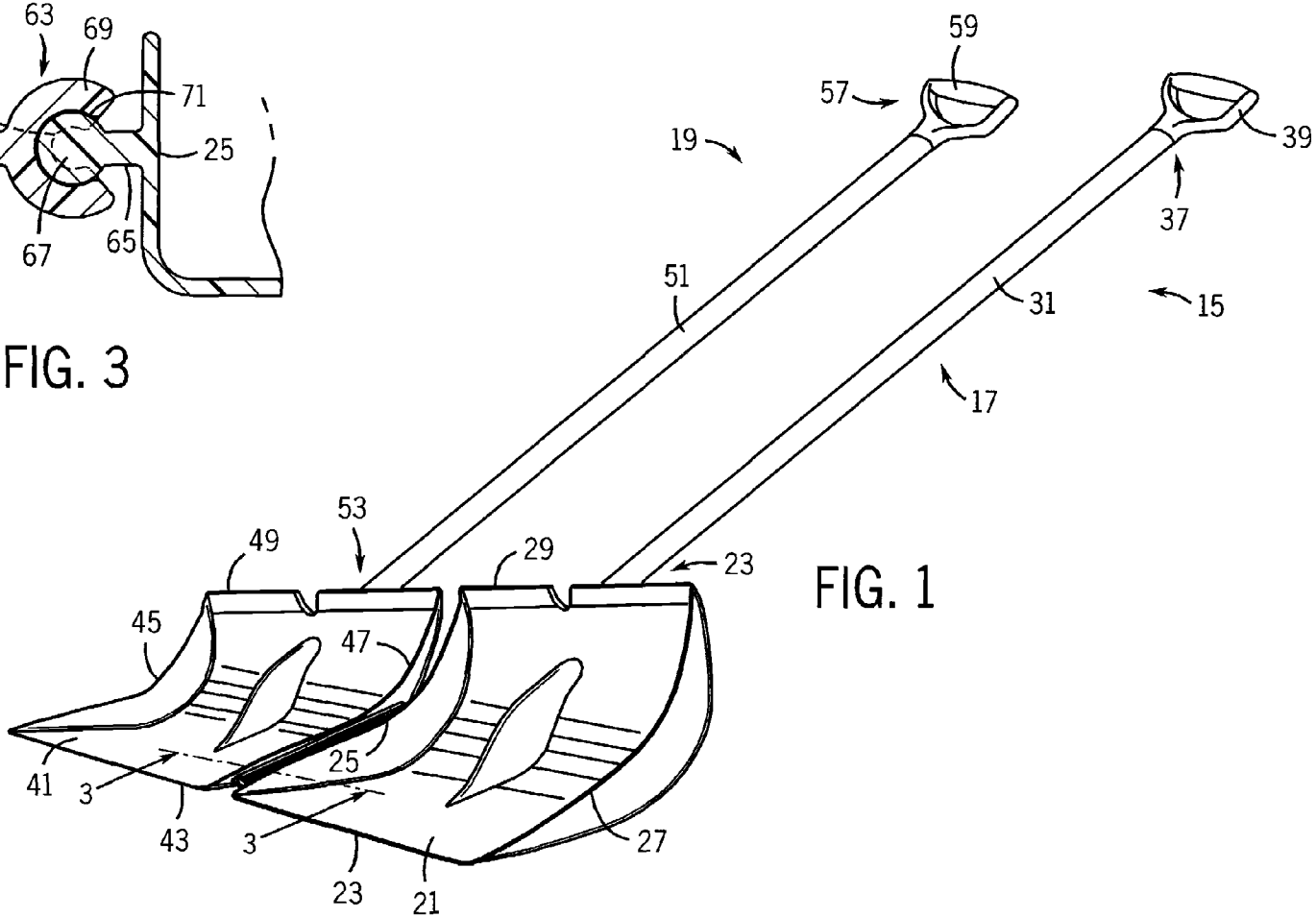
FIG. 1 is a perspective view of a first embodiment of the convertible snow shoveling device.

Referring to FIG. 1, a convertible snow shoveling device 15 is shown. The snow shoveling device 15 includes a first shovel 17 and a second shovel 19. The first shovel 17 has a substantially planar shovel blade 21, which, in the embodiments shown, is rectangular and has a forward lower scraping edge portion 23, first and second opposite side edge portions 25, 27, and a rearward upper edge portion 29. It should be recognized however that the shovel blade 21 could consist of a variety of shapes and sizes for snow shovels, many of which are well known in the art.

The first shovel 17 also has an elongated handle member 31 having a first proximal end portion 33 rigidly attached to the rear face of the planar shovel blade 21 and a second distal end portion 37. The attachment may be formed by any one of the many known fastening means for attaching a handle member to a shovel blade, such as for example, by clamps, connector pieces such as bolts or pins, or any one of a wide variety of adhesives. It is preferable however that the handle member 31 is at least rigidly attached to some portion of the shovel blade 21. As also shown in FIG. 1, a hand grip 39 is attached to the second end portion 37 of the elongated handle member 31. This type of hand grip 39 is well known in the art and facilitates the manual grasping and maneuvering of the shovel 17 during snow shoveling operations.

Similar to the first shovel 17, the second shovel 19 has a substantially planar shovel blade 41 having a forward lower scraping edge portion 43, a first side edge portion 45, an opposite second side edge portion 47 and rearward upper edge portion 49. An elongated handle member 51 has a proximal first end portion 53 rigidly attached to the rear face of the shovel blade 41, and a second distal end portion 57, as described above regarding the first shovel 17. Hand grip 59 is rigidly attached to the second end portion 57 of the handle member 51 and facilitates the manual grasping and maneuvering of the shovel 19 during snow shoveling operations.

The convertible snow shoveling device 15 includes means for releasably coupling the shovel blade 21 of the first shovel 17 to the shovel blade 41 of the second shovel 19. In general, the means for coupling includes at least one male connection part extending from an edge portion of the shovel blade 21 of the first shovel 17 and at least one female connection part disposed along an edge portion of the shovel blade 41 of the second shovel 19. The at least one female connection part is sized and shaped to receive the at least one male connection part to releasably couple the shovel blades 21, 41 together in a non-permanent yet rigid manner.

According to the present invention, the means for coupling the shovel blades 17, 41 may consist of a variety of structural elements that include the at least one male connection part and at least one female connection part arranged in complementary configurations. Several examples of embodiments of the male and female connection parts are described below and depicted in FIGS. 1-10. Although each of these embodiments depict male and female connection parts having a certain size and shape, and each of these embodiments depict arrangements having a certain type, size, shape and number of connection parts, it should be recognized that additional variations in type, size, shape and/or number of connection parts are possible and fall within the scope of the present invention.

Figure 3:
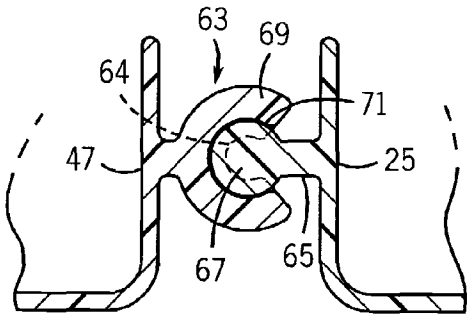
FIG. 3 is a section view taken along line 3-3 shown in FIG. 1 showing the coupling connection for the blades.
Figure 2:
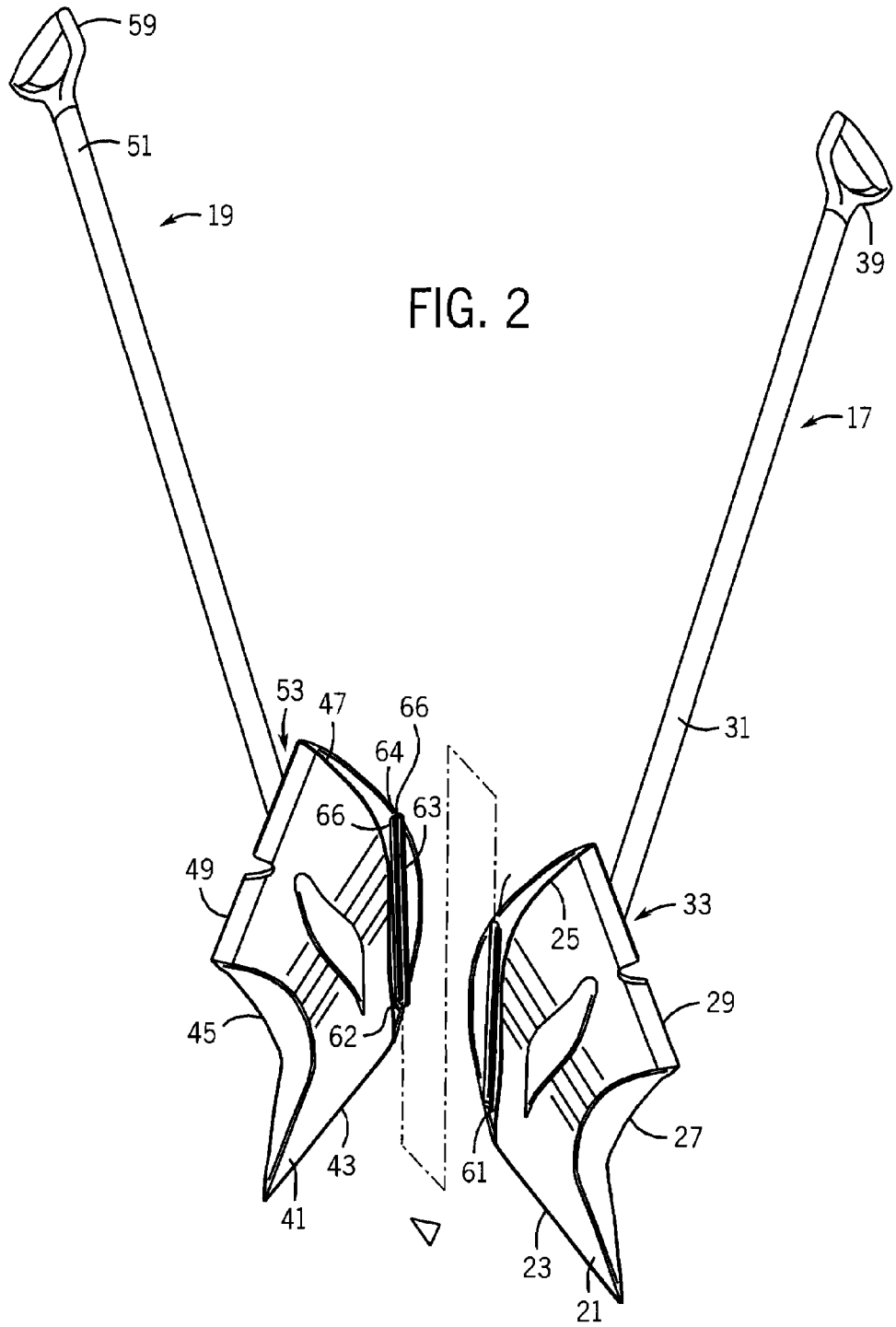
FIG. 2 is an exploded view of first and second snow shovels having first and second shovel blades that are uncoupled.

In the embodiment shown in FIGS. 1-3, the at least one male connection part consists of a post 61 attached to and extending along the first edge portion 25 of the shovel blade 21. The female connection part consists of a slotted tube 63 that is attached to and extends along the second edge portion 47 of the shovel blade 41. In this arrangement, the first shovel 17 and second shovel 19 are releasably interconnected by the post 61 and slotted tube 63 attached to the shovel blades 21, 41, respectively. As shown in FIGS. 2 and 3, the post 61 is sized to fit within the slotted tube 63 in a releasable manner. More specifically, the post 61 is slidably inserted into one of the opposite open end portions of the slotted tube 63 and retained therein to releasably couple the first shovel 17 to the second shovel 19.

As most clearly shown in FIG. 3, the post 61 preferably includes a flange portion 65 and an outwardly extending bulb portion 67. In this embodiment, the slotted tube 63 consists of a C-shaped member 69 having a circular-shaped open-ended slot 71 sized slightly larger than the bulb portion 67 of the post 61. When the bulb portion 67 of the post 61 is slid into the slot 71 of the C-shaped member 69, the post 61 is releasably held within the slotted tube 63 to couple the shovel blade 21 of the first shovel 17 to the shovel blade 41 of the second shovel 19 and form the convertible snow shoveling device 15. To uncouple the shovel blades 21, 41, the post 61 is slid out of either of the opposite open end portions of the slotted tube 63.

In a preferred embodiment, the upper end 66 of the slotted tube 63 has a closed portion or collar 64 for securing the post 61 in the tube 63 and preventing the post 61 from sliding upward, out of the slotted tube. Collar 64 is shown in FIG. 2 and in phantom in FIG. 3. In this arrangement the post 61 is slid into and out of the open lower end 62 of the slotted tube 63. The collar 64 is sized at least slightly smaller than the diameter of the post 61, thus preventing the post 61 from exiting the slotted tube via the upper end 66. Alternatively, the collar 64 may be placed on the lower end 62 of slotted tube 63.

It will be recognized by those skilled in the art, that the post 61 and slotted tube 63 may also releasably interconnect in a snap-fit arrangement. In this embodiment, the post 61 and slotted tube 63 would be sized and shaped such that, under pressure, the post 61 would snap fit into the slot 71 of the slotted tube 63 and be retained therein. It will also be recognized by those skilled in the art, that the shape of the post 61 and slotted tube 63 may vary as long as a releasable engagement is created between these two members. For example, the post 61 may have many planar edges such that it is, for example, square-shaped or triangle-shaped. Correspondingly, the slotted tube 63 should be shaped to safely receive and adequately secure the post 61 therein. More specifically the interconnection may be in a form commonly referred to as a dovetail connection in which a projecting tenon fits into a corresponding mortise to form a joint.

Figure 4:
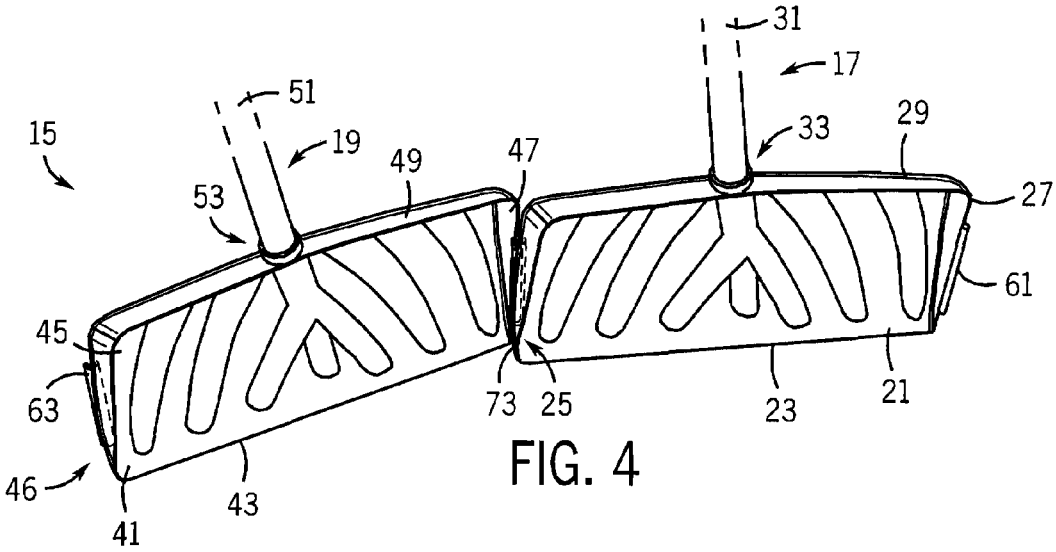
FIG. 4 is a perspective view of a second embodiment of the convertible snow shoveling device.
Figure 5:
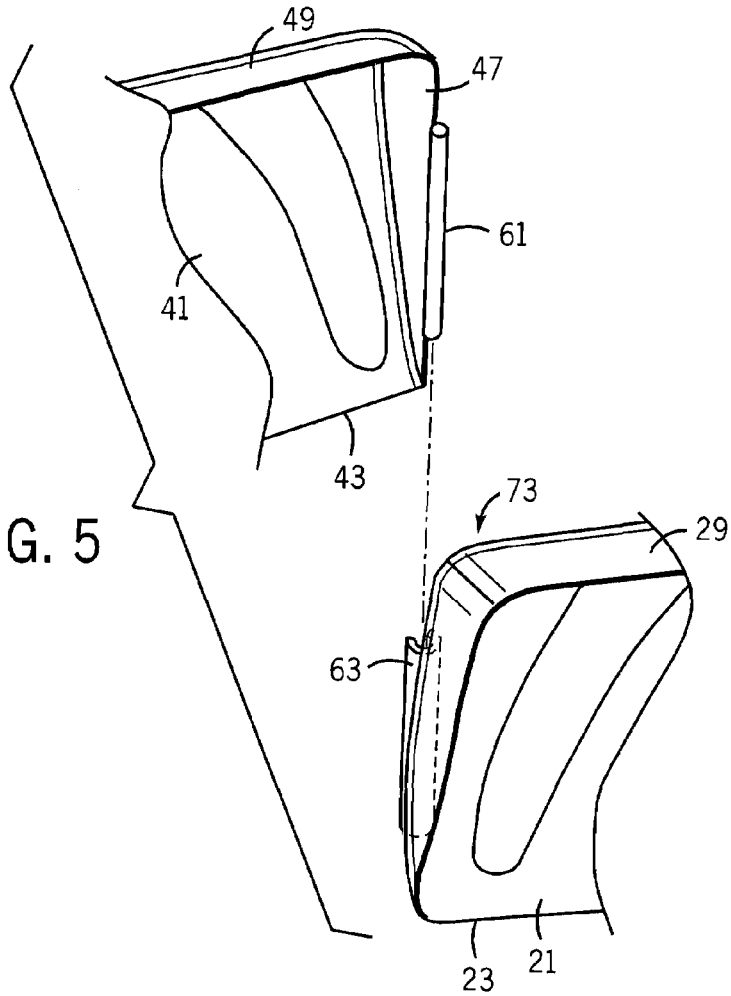
FIG. 5 is an exploded view of the embodiment shown in FIG. 4.

In the embodiment shown in FIG. 4, the female connection part, or slotted tube 63, is disposed further toward the rear of the side edge portion 73 of the shovel blade 21. The slotted tube 63 and post 61 are sized and shaped to releasably couple to each other in a similar manner as that described above. In this arrangement, however, when the post 61 is inserted into the slotted tube 63, the shovel blade 21 at least slightly overlaps with the shovel blade 41. In this embodiment the convertible snow shoveling device 15 provides an even more efficient means for shoveling snow because the overlapping relationship between the shovel blades 21, 41 prevents any snow from passing between the shovel blades 21, 41 when the two blades are coupled together to form the snow shoveling device 15.

Alternately, it is also feasible to design the snow shoveling device 15 wherein the male connection part, or post 61 is disposed along the rear edge portion of the shovel blade and the female connection part, or slotted tube 63, is disposed along the side edge portion of the adjacent shovel blade. The overlapping connection between the shovel blades 21, 41 will again be formed, which will prevent snow from passing between the shovel blades. It will also be recognized by those skilled in the art that the concept of applying either one of the male connection part or female connection part along a rear edge portion of one of the shovel blades is feasible in each of the embodiments shown in FIGS. 1-6.

As shown in FIG. 4, a slotted tube may also be disposed along the rear side edge portion 46 of the first side edge portion 45 of the shovel blade 41. A post 61 may be disposed along the second side edge portion 27 of the shovel blade 21. With this arrangement, a plurality of (i.e. more than two) shovel blades can be releasably connected to form an even wider convertible snow shoveling device 15. For example, three or four individual shovels can be interconnected to form the wider convertible snow shoveling device 15. Each shovel blade in the series will thus overlap with the adjacent shovel blades. This principle, i.e. providing shovel blades having a first edge portion with a female connection part and a second edge portion with a male connection part, such that a series of multiple shovel blades can be releasably interconnected, may be utilized with each of the embodiments shown in FIGS. 1-10.

Figure 6:
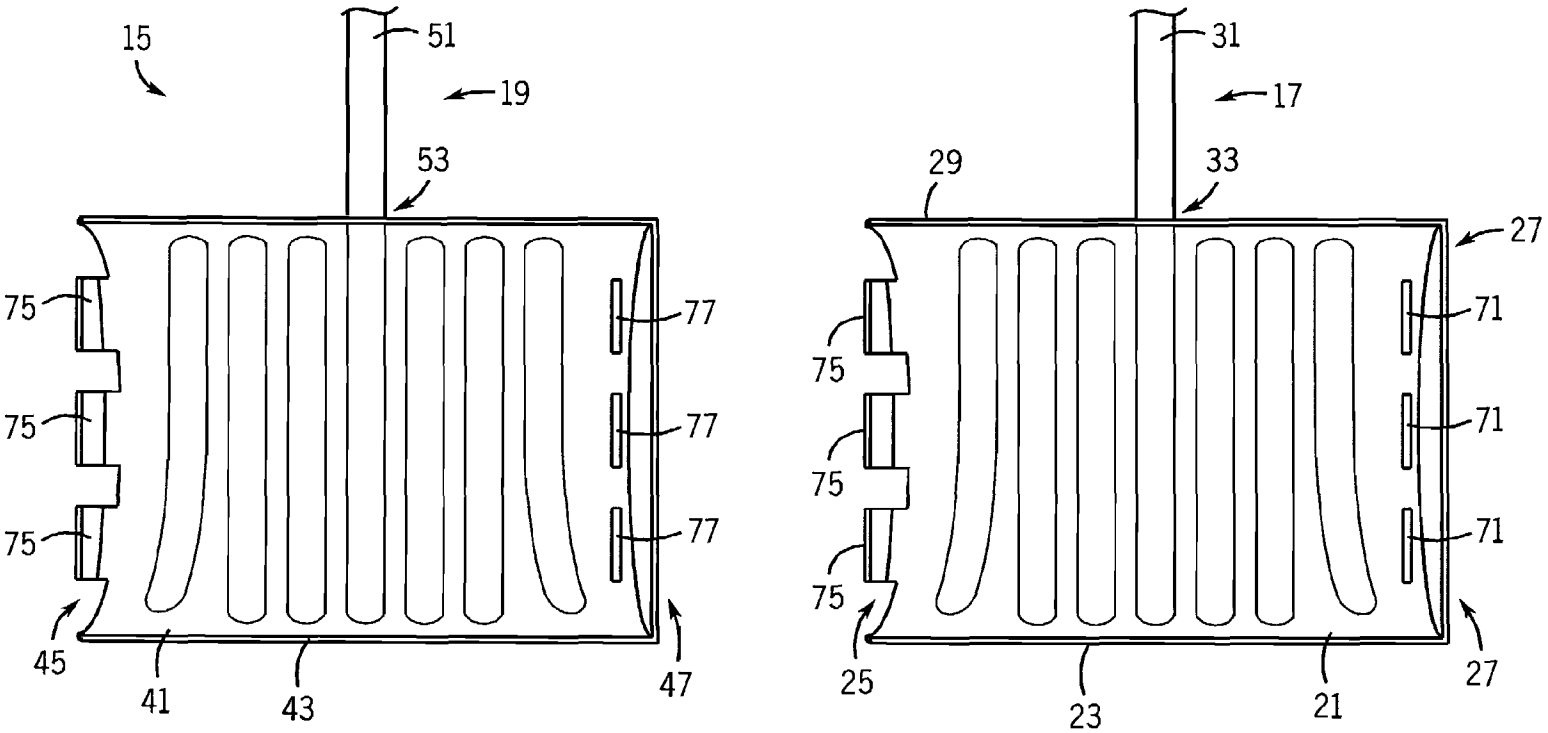
FIG. 6 is a plan view of a third embodiment of the convertible snow shoveling device.

Referring to FIG. 6, the male connection part may consist of one or more tabs 75 disposed along and extending outwardly from the edge portion 25 of the shovel blade 21. In this embodiment, the female connection part consists of one or more slots 77 disposed along the edge portion 47 of the shovel blade 41. The slots 77 are sized slightly larger than the tabs 75 and are shaped and positioned to receive the tabs 75 to releasably couple the shovel blades 21, 41 together to form the convertible snow shoveling device 15.

As also shown in FIG. 6, slots 71 are also disposed along the second side edge portion 27 of the shovel blade 2 land tabs 75 are also disposed along the first side edge portion 45 of the shovel blade 41. In this arrangement, similar to the embodiment shown in FIG. 4, a plurality of shovel blades can be releasably interconnected to form an even wider convertible snow shoveling device 15.

Figure 7:
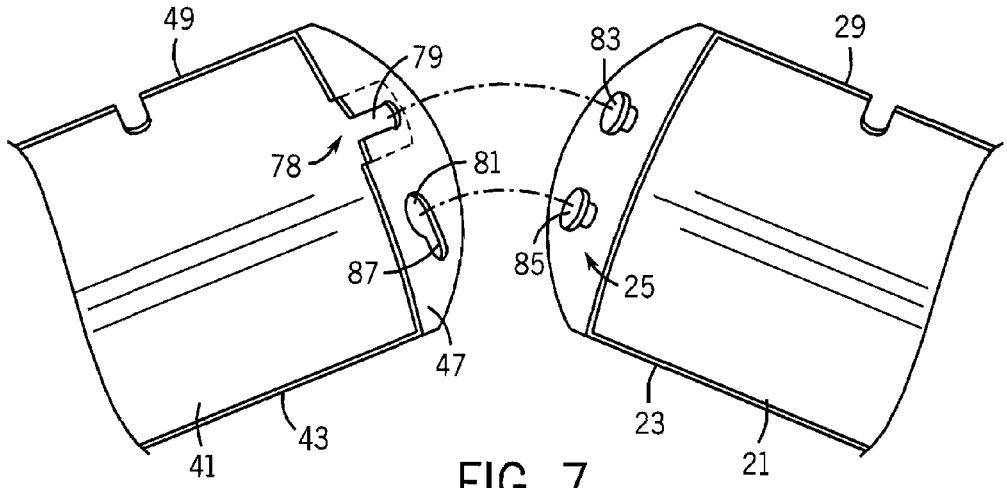
FIG. 7 is an exploded view of a fourth embodiment of the shovel blades of the convertible snow shoveling device.

Referring to the embodiment shown in FIG. 7, the male connection part may consist of two mushroom-shaped pegs 83, 85 disposed along and extending from the first side edge portion 25 of the shovel blade 21. The female connection part includes a slotted keyhole 79 and a notched keyhole 81 which are sized, shaped and positioned to receive the mushroom-shaped pegs 83, 85 in a releasable coupling arrangement. The edge portion 25 of the shovel blade 21 is thus releasably connected to the edge portion 47 of the shovel blade 41 by inserting the lower mushroom-shaped peg 85 into the notched keyhole 81 and thereafter rotating the shovel blade 21 to slide the upper mushroom-shaped peg 83 into the open end 78 of the slotted keyhole 79. The lower mushroom-shaped peg 85 is thereafter forced downwardly into the narrow portion 87 of the notched keyhole 81 to securely couple the shovel blade 21 to the shovel blade 41.

Figure 8:
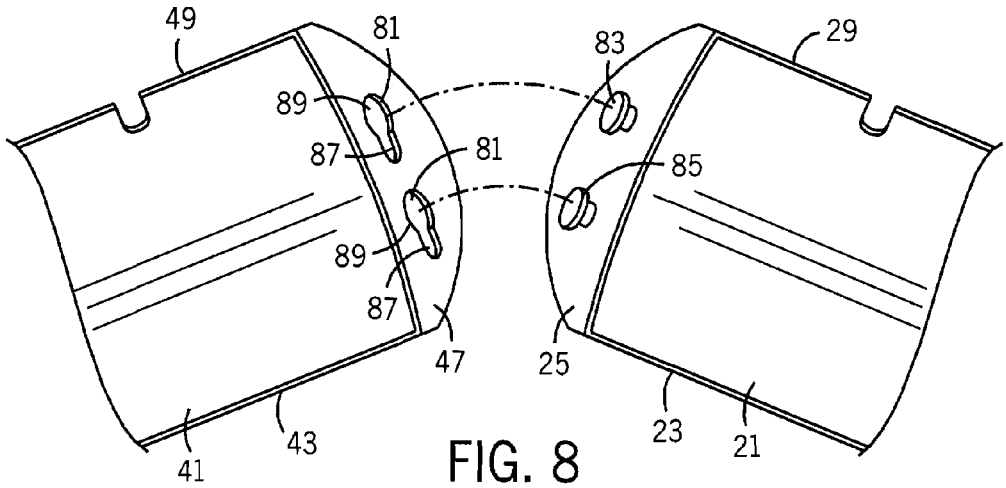
FIG. 8 is an exploded view of a fifth embodiment of the shovel blades of the convertible snow shoveling device.

In the embodiment shown in FIG. 8, the female connection part may alternately include a pair of notched key holes 81 that are sized and shaped to receive the upper and lower mushroom-shaped pegs 83, 85. The upper and lower mushroom-shaped pegs 83, 85 are inserted into the wide upper portion 89 of the notched key holes 81 and thereafter forced down into the narrow lower portion 87 of the notched key holes 81 to securely couple the shovel blades 21, 41 together.

Figure 9:
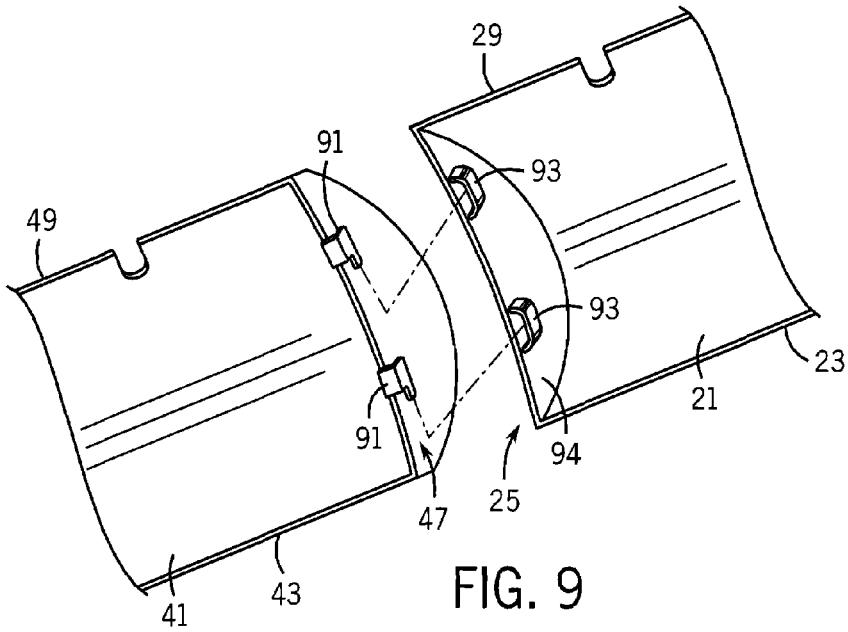
FIG. 9 is an exploded view of a sixth embodiment of the shovel blades of the convertible snow shoveling device.

Referring to FIG. 9, the male connection part may consist of a pair of downwardly oriented L-shaped tabs 91 and the female connection part may consist of a pair of loops 93 positioned along an inside edge 94 of the side edge portion 25 of the shovel blade 21. The loops 93 are sized, shaped and positioned to receive the downwardly facing L-shaped tabs 91 such that a releasable connection is formed between the shovel blades 21, 41.

Figure 10:
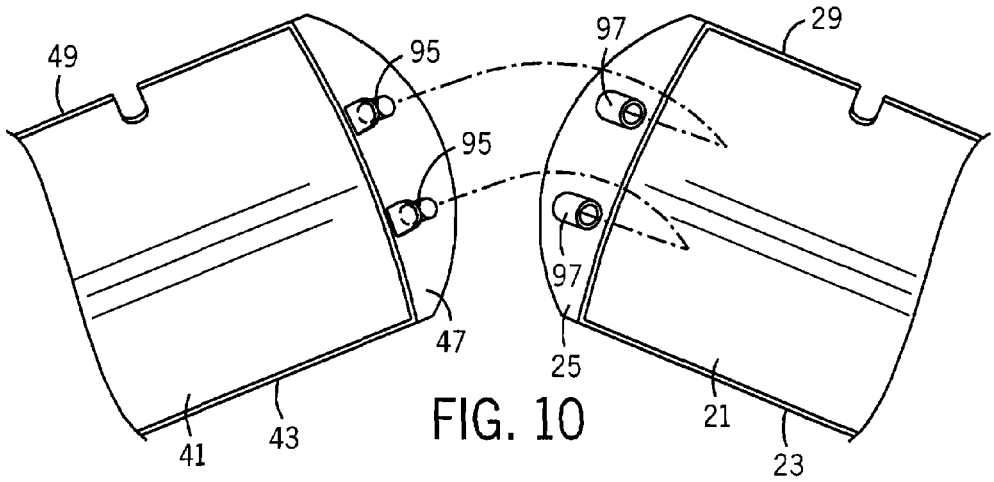
FIG. 10 is an exploded view of a seventh embodiment of the shovel blades of the convertible snow shoveling device.

Referring to FIG. 10, the male connection part may consist of a pair of rearwardly extending posts 95. The female connection part may consist of a pair of tubes 97 sized, shaped and positioned to receive the posts 95, such that a releasable connection is formed between the shovel blades 21, 41.

Figure 11:
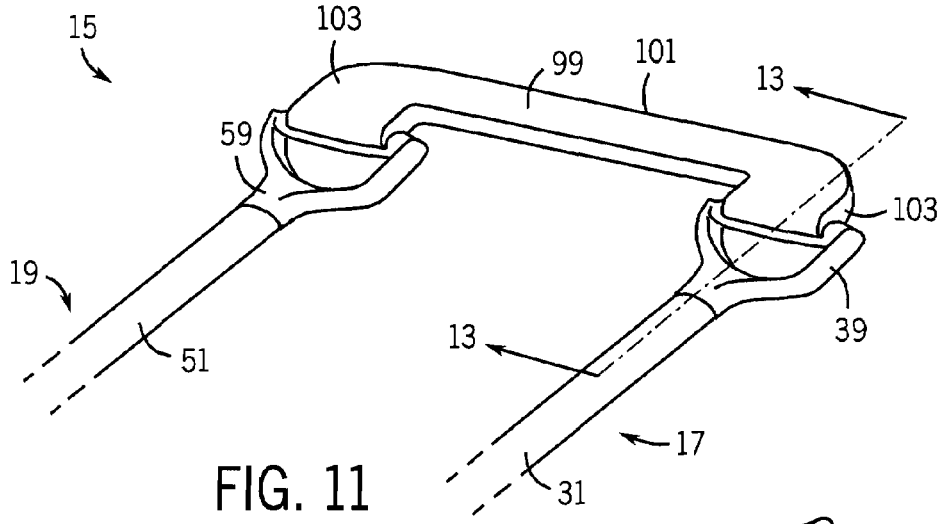
FIG. 11 is a perspective view of the elongated handlebar releasably attached to the hand grips of the snow shovels.
Figure 13:
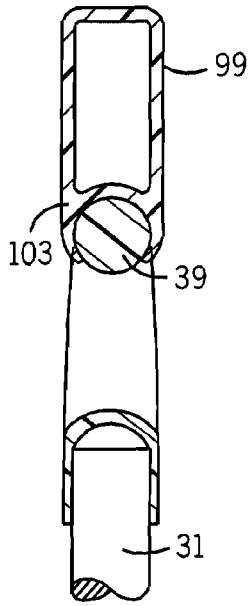
FIG. 13 is a section view taken along line 13-13 in FIG. 11.

Referring to FIG. 11, an elongated handlebar 99 is provided for interconnecting the hand grips 39, 59 of the first and second shovels 17, 19. As shown in FIG. 13, the handlebar 99 includes an elongated grasping portion 101 and downwardly extending U-shaped members 103 on each end. The U-shaped members 103 are sized and shaped to engage the hand grips 39, 59 in a snap fit arrangement such that the handlebar 99 is easily attached to and detached from the hand grips 39, 59 when the convertible snow shoveling device 15 is formed. The releasable handlebar 99 provides many advantages to the individual utilizing the convertible snow shoveling device 15. The handlebar 99 provides stability for the distal ends of handles 31 and 51 in use, and also provides a secure place for the user to grasp the shoveling device 15 and manipulate the device 15 to shovel snow. The releasable nature of the handlebar 99 allows the user to quickly and efficiently convert between use of the shoveling device 15 and the individual snow shovels 17, 19.

Figure 12:
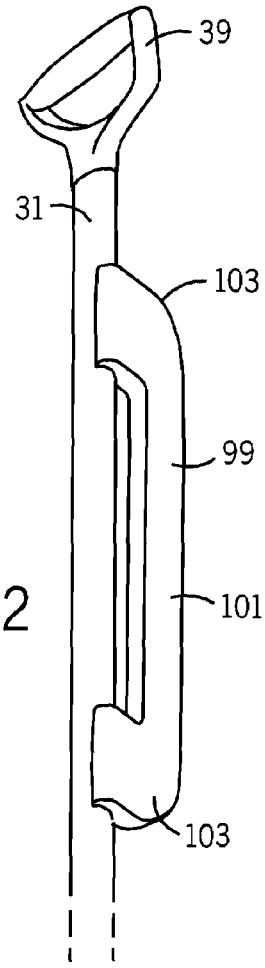
FIG. 12 is a perspective view of the elongated handlebar releasably attached to the handle element for storage.

As shown in FIG. 12, the channel members 103 of the handlebar 99 are also preferably sized and shaped such that they releasably engage either of the handle members 31, 51 in a snap fit arrangement. This aspect provides the advantage of being able to store the handlebar 99 on the individual snow shovel 17, 19 when the snow shoveling device 15 is not in use. Because the handlebar 99 is located on the individual snow shovel 17, 19, it is readily accessible when the shovel blades 21, 41 are to be joined together and the convertible snow shoveling device 15 is formed.

While this invention is susceptible to embodiments in many different forms, the drawings and specification describe in detail a preferred embodiment of the invention. They are not intended to limit the broad aspects of the invention to the embodiment illustrated. For example, although the particular embodiments shown depict a selected number of male and/or female parts, it should be recognized that the male and female parts may comprise any number of, or a combination of, the particular connection parts shown. In addition, the shapes and sizes of the individual male and female connection parts may vary depending upon the size and/or shape of the individual shovels.

What is claimed is:

1. A convertible snow shoveling device comprising:

a first shovel blade having an upper edge portion, a lower edge portion, and opposite substantially parallel side edge portions;

a first elongated handle coupled to and projecting from the first shovel blade in a direction substantially parallel to said side edge portions;

a second shovel blade having an upper edge portion, a lower edge portion, and opposite substantially parallel side edge portions;

a second elongated handle coupled to and projecting from the second shovel blade in a direction substantially parallel to said side edge portions;

at least one male connection part disposed between said upper and lower edge portions and along a side edge portion of the first shovel blade, and said male connection part extending longitudinally in a direction substantially parallel to the side edge portion of said first shovel blade; and at least one female connection part disposed between said upper and lower edge portions and along a side edge portion of the second shovel blade, and said female connection part extending longitudinally in a direction substantially parallel to the side edge portion of said second shovel blade, wherein the at least one female connection part is similarly sized and shaped to slidably receive the at least one male connection part along a line of direction that is substantially transverse to the lower edge portion of the second shovel blade to releasably couple the first and second shovel blades together by sliding the shovel blades in a direction parallel to the side edge portions, whereby the at least one male and female connection parts, by themselves, define a sliding self-interlock for preventing exit of the male connection part from the female connection part;

wherein the male connection part comprises a longitudinally extending post disposed along the edge portion of the first shovel blade and the female connection part comprises a longitudinally extending slotted tube disposed along the edge portion of the second shovel blade, the tube having a closed end portion engageable with the post for preventing sliding exit of the post therefrom.

2. The convertible snow shoveling device of claim 1 further comprising a hand grip on each handle disposed at a location distal from the first and second shovel blades.

3. A convertible snow shoveling device comprising:

a shovel blade having an upper edge portion, a lower edge portion and opposite substantially parallel side edge portions;

an elongated handle coupled to and projecting from the shovel blade in a direction substantially parallel to said side edge portions;

at least one male connection part disposed between said upper and lower edge portions along one side edge portion of the shovel blade, and said male connection part extending longitudinally in a direction substantially parallel to said one side edge portion; and at least one complementary female connection part disposed between said upper and lower edge portions along the other side edge portion of the shovel blade and said female connection part extending longitudinally in a direction substantially parallel to said other side edge portion, wherein the at least one female connection part is similarly sized and shaped slidably to receive the at least one male connection part alone a line of direction that is substantially transverse to the lower edge portion of the shovel blade so that a snow shoveling device with a shovel blade provided with opposite side edge portions having like male and female connection parts may be releasably coupled thereto, by sliding the shovel blades in a direction parallel to the side edge portions, whereby the at least one male and female connection parts, by themselves, define a sliding self-interlock for preventing exit of the male connecting part from the female connection part, wherein the male connection part comprises a longitudinally extending post disposed along the said one edge portion of the shovel blade and the female connection part comprises a longitudinally extending slotted tube disposed along the said other edge portion of the shovel blade, the tube having a closed end portion engageable with the post for preventing sliding exit of the post.

4. The convertible snow shoveling device of claim 3 further comprising a hand grip on the handle disposed at a location distal from the shovel blade.

* * * * *